US009385427B2

(12) United States Patent
Lee et al.

(10) Patent No.: US 9,385,427 B2
(45) Date of Patent: Jul. 5, 2016

(54) MULTI-BAND ANTENNA AND WIRELESS COMMUNICATION DEVICE EMPLOYING SAME

(71) Applicant: Chiun Mai Communication Systems, Inc., New Taipei (TW)

(72) Inventors: Yi-Chieh Lee, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 157 days.

(21) Appl. No.: 14/087,087

(22) Filed: Nov. 22, 2013

(65) Prior Publication Data

US 2014/0354508 A1 Dec. 4, 2014

(30) Foreign Application Priority Data

Jun. 3, 2013 (TW) ..... 102119559 A

(51) Int. Cl.
*H01Q 1/50* (2006.01)
*H01Q 5/00* (2015.01)
*H01Q 1/48* (2006.01)

(52) U.S. Cl.
CPC ..... *H01Q 5/0093* (2013.01); *H01Q 1/48* (2013.01); *H01Q 5/0058* (2013.01)

(58) Field of Classification Search
CPC ..... H01Q 1/243
USPC ..... 343/860
See application file for complete search history.

*Primary Examiner* — Graham Smith
(74) *Attorney, Agent, or Firm* — ScienBiziP, P.C.

(57) ABSTRACT

A multi-band antenna includes a radiating portion, a feed portion, a ground portion, a first switch module, and a second switch module. The radiating portion includes a plurality of connecting ends. The ground portion includes two ground sections with different impedances. The first switch module connects the feed portion to a first connecting end or a second connecting end, and the second switch module connects one of the ground sections to a third connecting end or a fourth connecting end. A wireless communication device employing the multi-band antenna is also disclosed.

6 Claims, 2 Drawing Sheets

MULTI-BAND ANTENNA AND WIRELESS COMMUNICATION DEVICE EMPLOYING SAME

BACKGROUND

1. Technical Field

The present disclosure relates to a multi-band antenna and a wireless communication device employing the multi-band antenna.

2. Description of Related Art

A wireless communication device uses an antenna to transmit and receive wireless signals at different frequencies, thus to be applied for use with different communication systems. However, a structure of the antenna is limited because of the small size of the wireless communication device, which causes the antenna to transmit and receive wireless signals at a very limit frequency band. Thus, improving multiple frequency bands performance of the antenna in the limit space in the wireless communication device, is still an important topic in the art.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
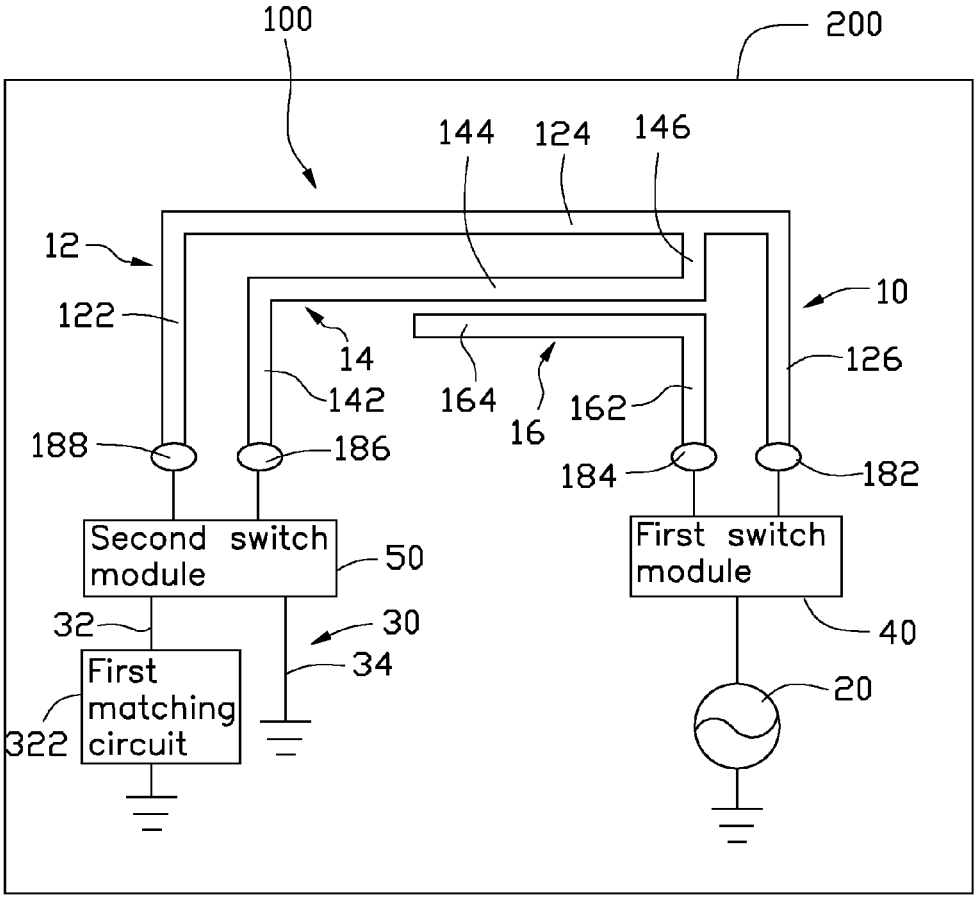
FIG. 1 is a schematic view of a first embodiment of a wireless communication device employing a multi-band antenna.

FIG. 1 shows a wireless communication device employing a multi-band antenna 100 according to a first embodiment. The multi-band antenna 100 is formed on a carrier 200 of the wireless communication device. The wireless communication device can be a mobile phone or a tablet computer, for example. The carrier 200 can be a housing of the wireless communication device or a circuit board mounted in the wireless communication device.

The multi-band antenna 100 includes a radiating portion 10, a feed portion 20, a ground portion 30, a first switch module 40, and a second switch module 50.

The radiating portion 10 includes a first connecting end 182, a second connecting end 184, a third connecting end 186, and a fourth connecting end 188. The radiating portion 10 further includes a first radiating section 12, a second radiating section 14, and a third radiating section 16. The first radiating section 12 is substantially a U-shaped sheet and includes a first arm 122, a second arm 124, and a third arm 126 connected in order. The first arm 122 and the third arm 126 are perpendicularly connected to opposite ends of the second arm 124 and are extending in a same direction. The first connecting end 182 is formed on an end of the third arm 126 away from the second arm 124. The fourth connecting end 188 is formed on an end of the first arm 122 away from the second arm 124.

The second radiating section 14 is a substantially Z-shaped sheet and includes a fourth arm 142, a fifth arm 144, and a sixth arm 146. The fourth arm 142 and the sixth arm 146 are perpendicularly connected to opposite ends of the fifth arm 144 and are extending in an opposite direction. The fourth arm 142 is spaced parallel to the first arm 122, the fifth arm 144 is spaced parallel to the second arm 124, and the sixth arm 146 is spaced parallel to the third arm 126 and is connected to the second arm 124. The third connecting end 186 is formed on an end of the fourth arm 142 away from the fifth arm 144.

The third radiating portion 16 is substantially an L-shaped sheet and includes a seventh arm 162 and an eighth arm 164. The seventh arm 162 is spaced parallel to the third arm 126, and the eighth arm 164 is spaced parallel to the fifth arm 144. The second connecting end 184 is formed on an end of the seventh arm 162 away from the eighth arm 164.

The feed portion 20 is electronically connected to the first connecting end 182 or the second connecting end 184 via the first switch module 40. The feed portion 20 is electronically connected to a radio-frequency (RF) circuit (not shown) of the circuit board of the wireless communication device and feeds RF signals to the radiating portion 10.

The first switch module 40 selectively connects the feed portion 20 to the first connecting end 182 or the second connecting end 184. The first switch module 40 can be switched manually or automatically by the RF circuit. In the first embodiment, the first switch module 40 is a RF switch.

The ground portion 30 is electronically connected to the third connecting end 186 or the fourth connecting end 188 via the second switch module 50. The ground portion 30 includes a first ground section 32 and a second ground section 34 both electronically connected to the second switch module 50. The ground portion 30 is for grounding the radiating portion 10. The first ground section 32 includes a first matching circuit 322. In the first embodiment, the first ground section 32 is an impedance matching circuit, which is formed by a plurality of inductances and capacitors connected in series or in parallel. The second ground section 34 connects the second switch module 50 to ground via a microstrip line. Thus, the first ground section 32 and the second ground section 34 form two ground paths with different impedances. The radiating portion 10 can transmit and receive RF signals at different frequency bands via the two ground paths.

The second switch module 50 selectively connects the first ground section 32 or the second ground section 34 to the third connecting end 186 or the fourth connecting end 188. The second switch module 50 can be switched manually or automatically by the RF circuit.

The first switch module 40 selectively connects the feed portion 20 to the first connecting end 182 or the second connecting end 184, and the second switch module 50 selectively connects the first ground section 32 or the second ground section 34 to the third connecting end 186 or the fourth connecting end 188. Thereby the radiating portion 10 forms different resonance paths, and then forms different resonance modes, thus transmitting and receiving RF signals at different frequency bands. For example, when the first switch module 40 connects the feed portion 20 to the first connecting end 182, and the second switch module 50 connects the first ground section 32 to the fourth connecting end 188. Thus, the radiating portion 10 feeds signals from the first connecting end 182 and is grounded via the fourth connecting end 188 and the first matching circuit 322. Thereby the radiating portion 10 forms a long current resonance path, and then forms a first resonance mode to transmit and receive signals at a first frequency band. The radiating portion 10 can transmit and receive signals at multiple frequency bands by the switch of the first switch module 40 and the second switch module 50.

Figure 2:
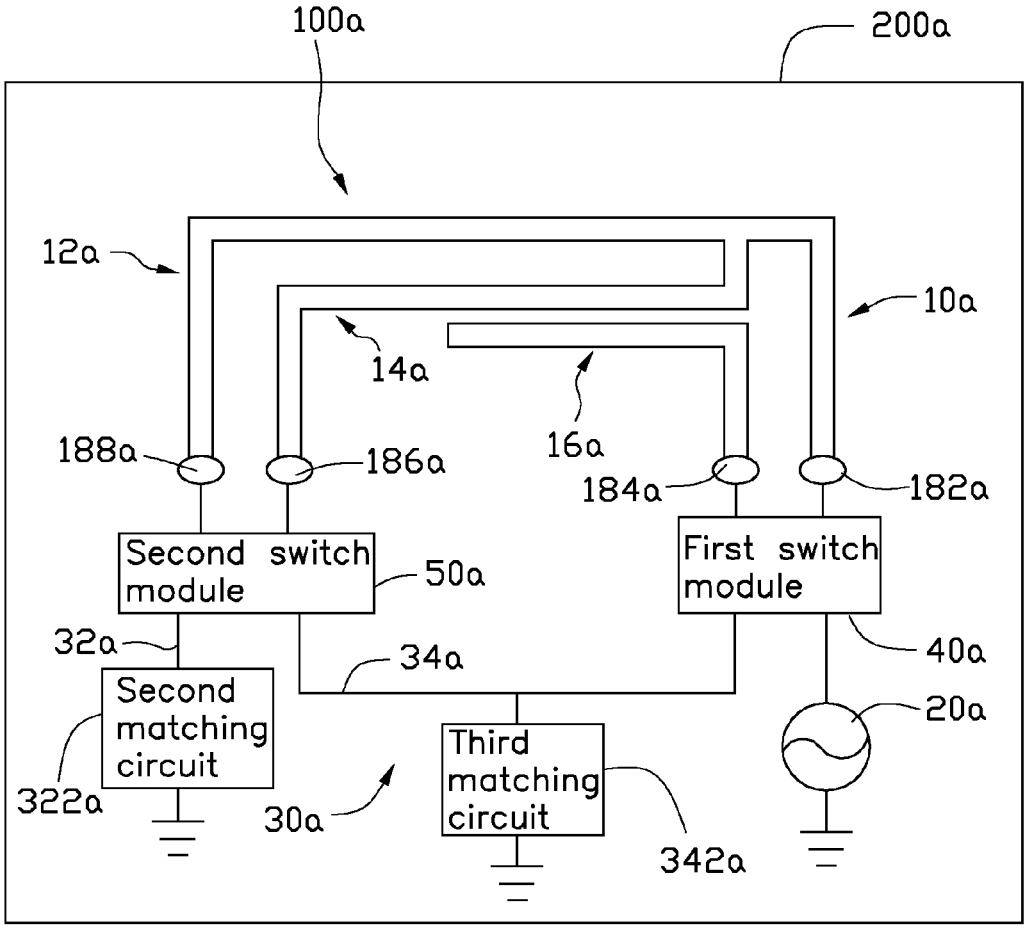
FIG. 2 is a schematic view of a second embodiment of the wireless communication device employing the multi-band antenna.

FIG. 2 shows a multi-band antenna 100*a* according to a second embodiment formed on a carrier 200*a* of the wireless communication device. The multi-band antenna 100*a* includes a feed portion 10*a*, a feed portion 20*a*, a ground portion 30*a*, a first switch module 40*a*, and a second switch module 50*a*. In the second embodiment, the ground portion 30*a* includes a first ground section 32*a* and a second ground section 34*a*. The first ground section 32*a* includes a second matching circuit 322*a*, the second ground section 34*a* includes a third matching circuit 342*a*. The second matching circuit 322*a* and the third matching circuit 342*a* have different impedances. The first switch module 40*a* is electronically connected to the feed portion 20*a*, the second ground section 34*a*, a first connecting end 182*a* and a second connecting end 184*a* of the radiating portion 10*a*.

The first switch module 40*a* electronically connects the feed portion 20*a* to the first connecting end 182*a* or the second connecting end 184*a*. The first switch module 40*a* further selectively electronically connects the second ground section 34*a* to the second connecting end 184*a* or the first connecting end 182*a* which is not connected to the feed portion 20*a*. The second switch module 50*a* electronically connects the first ground section 32*a* or the second ground section 34*a* to the third connecting end 186*a* or the fourth connecting end 188*a*. Thereby the radiating portion 10*a* forms different current resonance paths, and then forms different resonance modes to transmit and receive signals at different frequency bands. For example, when the first switch module 40*a* electronically connects the feed portion 20*a* to the first connecting end 182*a* and connects the second ground section 34*a* to the second connecting end 184*a*. At the same time the second switch module 50*a* has no connection or electronically connects the first ground section 32*a* to the third connecting end 186*a* or the fourth connecting end 188*a*. When the second switch module 50*a* has no connection, the radiating portion 10*a* feeds signals via the first connecting end 182*a* and is grounded via the second connecting end 184*a* and the third matching circuit 342*a*. Thereby the radiating portion 10*a* forms a short current resonance path, and then forms a second resonance mode to transmit and receive signals at a second frequency band. The radiating portion 10*a* can transmit and receive signals at multiple frequency bands by the switch of the first switch module 40*a* and the second switch module 50*a*.

The multi-band antenna 100 includes a plurality of connecting ends formed on the radiating portion 10, and switchable electronically connects the feed portion 20 and different ground paths to the plurality of connecting ends, thus forming different resonance modes to transmit and receive signals at different frequency bands. The switch of the first switch module 40 and the second switch module 50 is multiple, thus the multi-band antenna 100 is applied for wireless communication systems with multiple frequency bands.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A multi-band antenna comprising:

a radiating portion comprising a plurality of connecting ends, the connecting ends at least comprising a first connecting end, a second connecting end, a third connecting end, and a fourth connecting end;

a feed portion;

a ground portion comprising two ground sections with different impedances;

a first switch module; and a second switch module;

wherein if the first switch module connects the feed portion to the first connecting end or the second connecting end, the second switch module connects one of the ground sections to a third connecting end or a fourth connecting end; and if the first switch module connects the feed portion to the first connecting end or the second connecting end, and connects one of the ground sections to the second connecting end or the first connecting end which is not connected to the feed portion, the second switch module connects one of the ground sections to the third connecting end or the fourth connecting end, or the second switch module has no connection, thereby the radiating portion forms different resonance modes to transmit and receive wireless signals at multiple frequency bands;

wherein the radiating portion comprises a first radiating section, a second radiating section, and a third radiating section, the first connecting end and the fourth connecting end are formed on opposite ends of the first radiating section, the second connecting end is formed on an end of the third radiating section, and the third connecting end is formed on an end of the second radiating section;

wherein the first radiating section comprises a first arm, a second arm, and a third arm connected in order, the first arm and the third arm are perpendicularly connected to opposite ends of the second arm and are extending in a same direction, the first connecting end is formed an end of the third arm away from the second arm, the fourth connecting end is formed an end of the first arm away from the second arm;

wherein the second radiating section comprises a fourth arm, a fifth arm, and a sixth arm, the fourth arm and the sixth arm are perpendicularly connected to opposite ends of the fifth arm and are extending in an opposite direction, the fourth arm is parallel to the first arm, the fifth arm is parallel to the second arm, and the sixth arm is parallel to the third arm and is connected to the second arm, the third connecting end is formed on an end of the fourth arm away from the fifth arm; and wherein the third radiating portion comprises a seventh arm and an eighth arm, the seventh arm is parallel to the third arm, and the eighth arm is spaced parallel to the fifth arm, the second connecting end is formed on an end of the seventh arm away from the eighth arm.

2. The multi-band antenna as claimed in claim 1, wherein the ground portion comprises a first ground section and a second ground section, the first ground section and the second ground section both are connected to the second switch module, the first ground section connects to the second switch module via a first matching circuit, the second ground section connects to the second switch module via a microstrip line.

3. The multi-band antenna as claimed in claim 1, wherein the ground portion comprises a first ground section and a second ground section, the first ground section and the second ground section both are connected to the second switch module, the second ground section further connects to the first switch module, the first ground section connects to the second switch module via a second matching circuit, the second ground section connects to the second switch module and the first switch module via a third matching circuit.

4. A wireless communication device, comprising:

a carrier; and a multi-band antenna formed on the carrier, the multi-band antenna comprising;

a radiating portion comprising a plurality of connecting ends, the connecting ends at least comprising a first connecting end, a second connecting end, a third connecting end, and a fourth connecting end;

a feed portion;

a ground portion comprising two ground sections with different impedances;

a first switch module; and a second switch module;

wherein if the first switch module connects the feed portion to the first connecting end or the second connecting end, the second switch module connects one of the ground sections to a third connecting end or a fourth connecting end; and if the first switch module connects the feed portion to the first connecting end or the second connecting end, and connects one of the ground sections to the second connecting end or the first connecting end which is not connected to the feed portion, the second switch module connects one of the ground sections to the third connecting end or the fourth connecting end, or the second switch module has no connection, thereby the radiating portion forms different resonance modes to transmit and receive wireless signals at multiple frequency bands;

wherein the radiating portion comprises a first radiating section, a second radiating section, and a third radiating section, the first connecting end and the second fourth connecting end are formed on opposite ends of the first radiating section, the second connecting end is formed on an end of the third radiating section, and the third connecting end is formed on an end of the second radiating section;

wherein the first radiating section comprises a first arm, a second arm, and a third arm connected in order, the first arm and the third arm are perpendicularly connected to opposite ends of the second arm and are extending in a same direction, the first connecting end is formed an end of the third arm away from the second arm, the fourth connecting end is formed an end of the first arm away from the second arm;

wherein the second radiating section comprises a fourth arm, a fifth arm, and a sixth arm, the fourth arm and the sixth arm are perpendicularly connected to opposite ends of the fifth arm and are extending in an opposite direction, the fourth arm is parallel to the first arm, the fifth arm is parallel to the second arm, and the sixth arm is parallel to the third arm and is connected to the second arm, the third connecting end is formed on an end of the fourth arm away from the fifth arm; and wherein the third radiating portion comprises a seventh arm and an eighth arm, the seventh arm is parallel to the third arm, and the eighth arm is spaced parallel to the fifth arm, the second connecting end is formed on an end of the seventh arm away from the eighth arm.

5. The wireless communication device as claimed in claim 4, wherein the ground portion comprises a first ground section and a second ground section, the first ground section and the second ground section both are connected to the second switch module, the first ground section connects to the second switch module via a first matching circuit, the second ground section connects to the second switch module via a microstrip line.

6. The wireless communication device as claimed in claim 4, wherein the ground portion comprises a first ground section and a second ground section, the first ground section and the second ground section both are connected to the second switch module, the second ground section further connects to the first switch module, the first ground section connects to the second switch module via a second matching circuit, the second ground section connects to the second switch module and the first switch module via a third matching circuit.

* * * * *